US009192800B1

(12) United States Patent
Meyer et al.

(10) Patent No.: US 9,192,800 B1
(45) Date of Patent: Nov. 24, 2015

(54) EXERCISE EQUIPMENT HAVING A WEIGHT STACK, CONNECTORS FOR EXERCISE EQUIPMENT HAVING A WEIGHT STACK AND METHODS OF ASSEMBLING EXERCISE EQUIPMENT HAVING A WEIGHT STACK

(71) Applicant: Brunswick Corporation, Lake Forest, IL (US)

(72) Inventors: Mathew Meyer, Montrose, MN (US); Dennis Whaley, Otsego, MN (US)

(73) Assignee: Brunswick Corporation, Lake Forest, IL (US)

( * ) Notice: Subject to any disclaimer, the term of this patent is extended or adjusted under 35 U.S.C. 154(b) by 178 days.

(21) Appl. No.: 13/719,007

(22) Filed: Dec. 18, 2012

(51) Int. Cl.
*A63B 21/062* (2006.01)
*A63B 21/00* (2006.01)

(52) U.S. Cl.
CPC ..... *A63B 21/00003* (2013.01)

(58) Field of Classification Search
CPC ..... A63B 21/00; A63B 21/00003; A63B 21/00007; A63B 21/0001; A63B 21/00065; A63B 21/00069; A63B 21/00083; A63B 21/00094; A63B 21/00101; A63B 21/0012; A63B 21/06; A63B 21/062; A63B 21/08; A63B 21/1453; A63B 21/1465; A63B 21/1469; A63B 21/1488; A63B 21/15; A63B 21/151; A63B 21/152; A63B 2021/0623; A63B 2021/0626; A63B 23/12; A63B 23/1209; A63B 23/1218; A63B 23/1245; A63B 23/1281
USPC ..... 482/92–94, 98–103
See application file for complete search history.

(56) References Cited

U.S. PATENT DOCUMENTS

| | | | | | |
|---|---|---|---|---|---|
| 4,542,899 | A * | 9/1985 | Hendricks | 482/102 |
| 4,627,615 | A * | 12/1986 | Nurkowski | 482/98 |
| 4,878,662 | A * | 11/1989 | Chern | 482/98 |
| 4,880,227 | A * | 11/1989 | Sowell | 482/102 |
| 5,342,271 | A * | 8/1994 | Long | 482/98 |
| 6,117,049 | A * | 9/2000 | Lowe | 482/4 |
| 6,193,635 | B1 * | 2/2001 | Webber et al. | 482/98 |
| 6,468,189 | B2 * | 10/2002 | Alessandri | 482/99 |
| 6,497,639 | B2 * | 12/2002 | Webber et al. | 482/98 |
| 6,551,223 | B2 * | 4/2003 | Cheng | 482/99 |
| 6,719,672 | B1 * | 4/2004 | Ellis et al. | 482/99 |
| 7,377,887 | B1 | 5/2008 | Rosenow et al. | |
| 7,413,532 | B1 | 8/2008 | Monsrud et al. | |
| 7,507,190 | B2 * | 3/2009 | Piane, Jr. | 482/99 |
| 7,708,672 | B2 * | 5/2010 | Gibson et al. | 482/98 |
| 7,749,140 | B1 * | 7/2010 | Lindemeier et al. | 482/82 |
| 7,758,478 | B2 * | 7/2010 | Golesh et al. | 482/98 |
| 7,815,554 | B2 * | 10/2010 | Gibson et al. | 482/98 |
| 7,871,357 | B2 * | 1/2011 | Gibson et al. | 482/98 |
| 7,922,629 | B1 * | 4/2011 | Batca | 482/94 |
| 8,591,386 | B2 * | 11/2013 | Meyer | 482/99 |
| 2003/0092542 | A1 * | 5/2003 | Bartholomew et al. | 482/99 |
| 2011/0287905 | A1 * | 11/2011 | Reyes | 482/94 |
| 2012/0295772 | A1 * | 11/2012 | Meyer | 482/99 |

* cited by examiner

*Primary Examiner* — Oren Ginsberg
*Assistant Examiner* — Gary D Urbiel Goldner
(74) *Attorney, Agent, or Firm* — Andrus Intellectual Property Law, LLP

(57) ABSTRACT

Exercise equipment comprises a weight stack configured to oppose a given exercise motion through a cable and pulley system and an elongated connector connecting the cable to a weight stack. The elongated connector comprises a first threaded portion located proximate to the weight stack and a second portion located distal from the weight stack. The first threaded portion is engaged with the weight stack and has a diameter that is greater than a diameter of the second portion such that an operator can visually determine whether the connector is fully engaged with a threaded receptacle in the weight stack.

15 Claims, 5 Drawing Sheets

EXERCISE EQUIPMENT HAVING A WEIGHT STACK, CONNECTORS FOR EXERCISE EQUIPMENT HAVING A WEIGHT STACK AND METHODS OF ASSEMBLING EXERCISE EQUIPMENT HAVING A WEIGHT STACK

FIELD

The present disclosure relates to exercise equipment including weight training equipment having a weight stack for resisting an exercise movement. The disclosure further relates to connectors for exercise equipment having a weight stack and methods of assembling exercise equipment having one or more weight stacks and/or cables.

BACKGROUND

Various types of exercise equipment providing various types of exercise movements are known in the prior art. A weight stack is commonly used for opposing a given exercise motion through a cable and pulley system.

U.S. Pat. No. 7,413,532, which is incorporated herein by reference in entirety, discloses exercise apparatus having a weight stack for opposing a given exercise motion. The weight stack has a first set of a plurality of primary weights vertically stacked on each other, a primary weight selector having a plurality of settings selectively controlling the number of weights to be lifted during the exercise motion, a second set of a plurality of secondary weights, and a secondary weight selector having a plurality of settings selectively controlling the number of secondary weights to be lifted during the exercise motion, the secondary weights providing supplemental incremental weight.

U.S. Pat. No. 7,377,887, which is incorporated herein by reference in entirety, discloses exercise apparatus for guided exercise movement includes a primary arm pivotally mounted to a frame for pivotal movement about a fixed pivot relative to the frame, a movement arm pivotally mounted to the primary arm for pivotal movement relative to the primary arm about a floating pivot relative to the frame, a stationary cam fixed on the frame, and a follower on the movement arm engaging the stationary cam and guided thereby to control the path of movement of the movement arm about the floating pivot during movement of the primary arm about the fixed pivot. The cam has a cam track surface controlling compound movement of the movement arm.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In some examples, exercise equipment comprises a weight stack configured to oppose a given exercise motion through a cable and pulley system and an elongated connector connecting the cable to the weight stack. The elongated connector comprises a first threaded portion located proximate to the weight stack and a second portion located distal from the weight stack. The first threaded portion is engaged with the weight stack and has a diameter that is greater than a diameter of the second portion such that an operator can visually determine that the connector is fully engaged with a threaded receptacle in the weight stack when the first threaded portion is fully disposed in the threaded receptacle.

In other examples, a method of assembling exercise equipment comprises: providing a weight stack configured to oppose a given exercise motion through a cable and pulley system; and connecting the cable to the weight stack via and an elongated connector. The elongated connector comprises a first threaded portion located proximate to the weight stack and a second portion located distal from the weight stack. The first threaded portion is engaged with the weight stack and has a diameter that is greater than a diameter of the second portion. The method further comprises determining whether the connector is fully engaged with a threaded receptacle in the weight stack by determining whether the first threaded portion is fully disposed in the threaded receptacle.

In other examples, an elongated connector is provided for exercise equipment. The elongated connector comprises a first threaded portion located proximate to the weight stack and a second portion located distal from the weight stack. The first threaded portion is for engagement with the weight stack and has a diameter that is greater than a diameter of the second portion such that an operator can visually determine whether the connector is fully engaged with a threaded receptacle in the weight stack when the first threaded portion is fully disposed in the threaded receptacle.

BRIEF DESCRIPTION OF THE DRAWINGS

Examples of exercise equipment and connectors for exercise equipment, including weight training equipment having a weight stack for providing weight resistance resisting an exercise movement are described with reference to the following drawing figures. The same numbers are used throughout the drawing figures to reference like features and components.

DETAILED DESCRIPTION OF THE DRAWINGS

In the present description, certain terms have been used for brevity, clearness, and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives, and modifications are possible within the scope of the appended claims.

Figure 1:
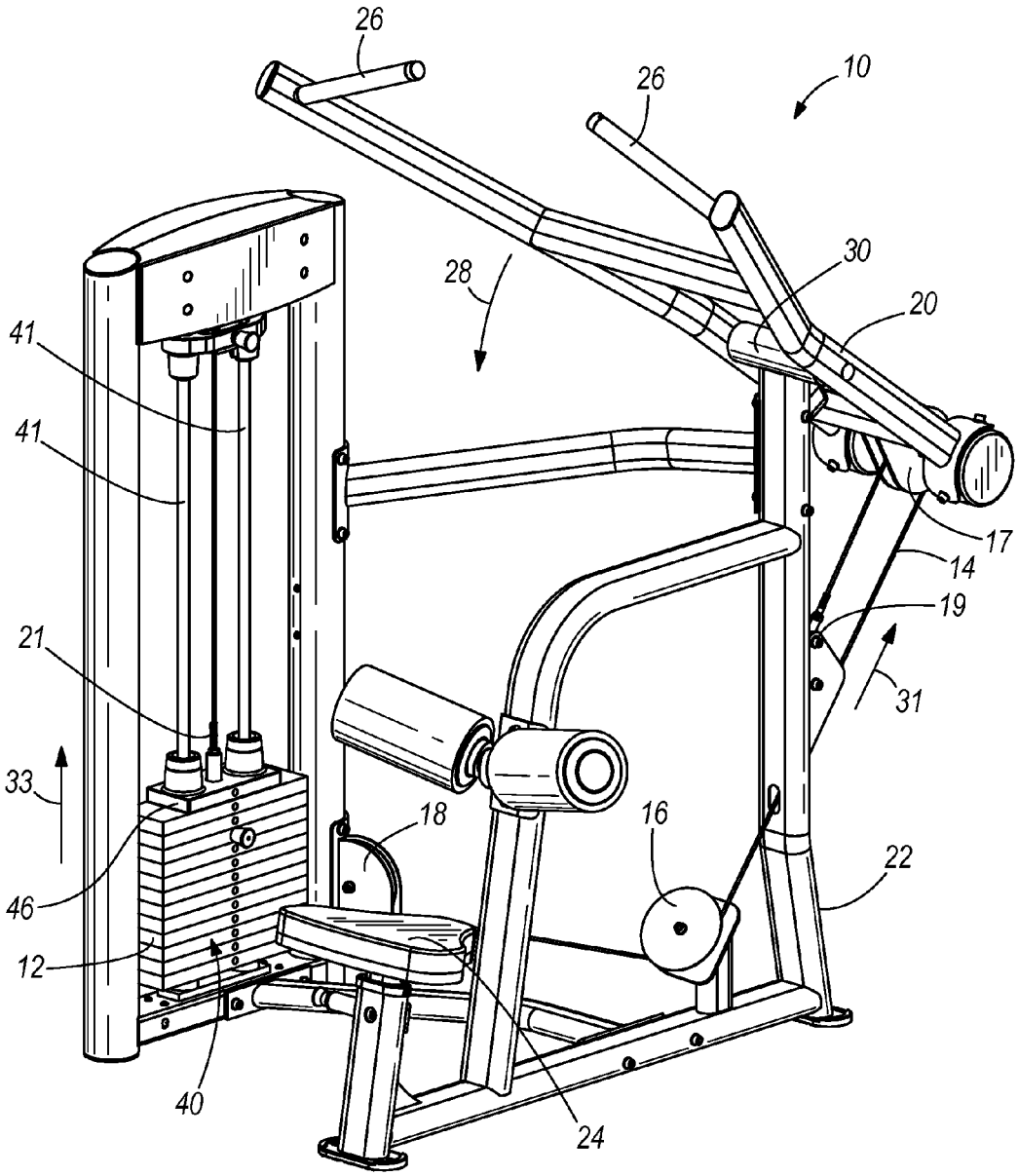
FIG. 1 is a perspective view of exercise equipment.

FIG. 1 depicts exercise equipment 10 in the form of a lat pull-down machine. The exercise equipment incorporates a weight stack 12 that is configured to oppose a given exercise motion through a cable and pulley system, including e.g. cable 14 trained around pulleys 16, 17, 18. The present disclosure is applicable to a wide variety of other types of exercise equipment in addition to lat pull-down machines, such as for example, leg press machines, chest press machines, arm curl machines and/or the like. The lat pull-down machine shown in FIG. 1 is exemplary and for discussion purposes only and the present disclosure can be implemented with most other exercise equipment that incorporates a cable and weight arrangement. In this example, the cable 14 is connected at one end 19 to a pivot arm 20 configured to pivot about a frame 22 and an opposite end 21 to the weight stack 12, as will be described further herein below. The exercise equipment 10 also has the frame 22 and a supporting seat 24 upon which an operator sits. In use, the operator grasps the handles 26 of the pivot arm 20 and pulls generally downwardly in the direction of arrow 28. This causes the pivot arm 20 to pivot about the frame 22 at pivot point 30. Pivot arm 20 thus pulls upwardly on the cable 14 in the direction of arrow 31. Upward movement of the cable 14 is transferred via the noted cable and pulley system to pull upwardly on the weight stack 12 in the direction of arrow 33. Again, the lat pull-down machine shown in FIG. 1 is exemplary and for discussion purposes only and the present disclosure can be implemented with most other exercise equipment that incorporates a cable and weight arrangement.

Through research and experimentation, the present inventors have determined that prior art connectors for connecting the end 21 of the cable 14 to the weight stack 12 have functional and safety drawbacks. For example, prior art connectors typically consist of a threaded stud having a single diameter along its length. In use, the inventors have determined that it is difficult to ascertain whether there is sufficient length of engagement between the prior art threaded stud and its connection point on the weight stack 12. If not enough threads are engaged with the weight stack 12, the cable 14 may inadvertently disengage from the weight stack 12 causing the weight stack 12 to unexpectedly fall. This possibly can cause injury to the operator and/or damage to the exercise machine. Further, the inventors have found that it is often difficult to adjust the threaded engagement between the prior art stud and weight stack 12 because it can be difficult to engage with and turn the stud.

FIGS. 1-4 depict one example of an elongated connector 32 according to the present disclosure. The elongated connector 32 is configured to connect the end 21 of the cable 14 to the weight stack 12. The connector 32 has a first threaded portion 34 located proximate to the weight stack 12 and a second portion 36 located opposite the first threaded portion 34 and extending outwardly away from the weight stack 12. The first threaded portion 34 is engaged with the weight stack 12 in a threaded connection, as will be described further herein below, and has a diameter 1) that is greater than a diameter d of the second portion 36. In the example shown, the weight stack 12 includes a plurality of weights 40 (FIG. 1) and a bayonet 42 that extends through through-bores 44 in the weights 40 in the plurality. The plurality of weights 40 of the weight stack 12 rides along vertical support bars 41 (FIG. 1), as is conventional, and includes a head plate 46 through which the bayonet 42 extends. In this example, the threaded receptacle 38 is formed in the free end of the bayonet 42 extending above the head plate 46. In other examples, the threaded receptacle 38 could be formed in the uppermost weight in the weight stack 12 or in another component of the weight stack 12.

Figure 3:
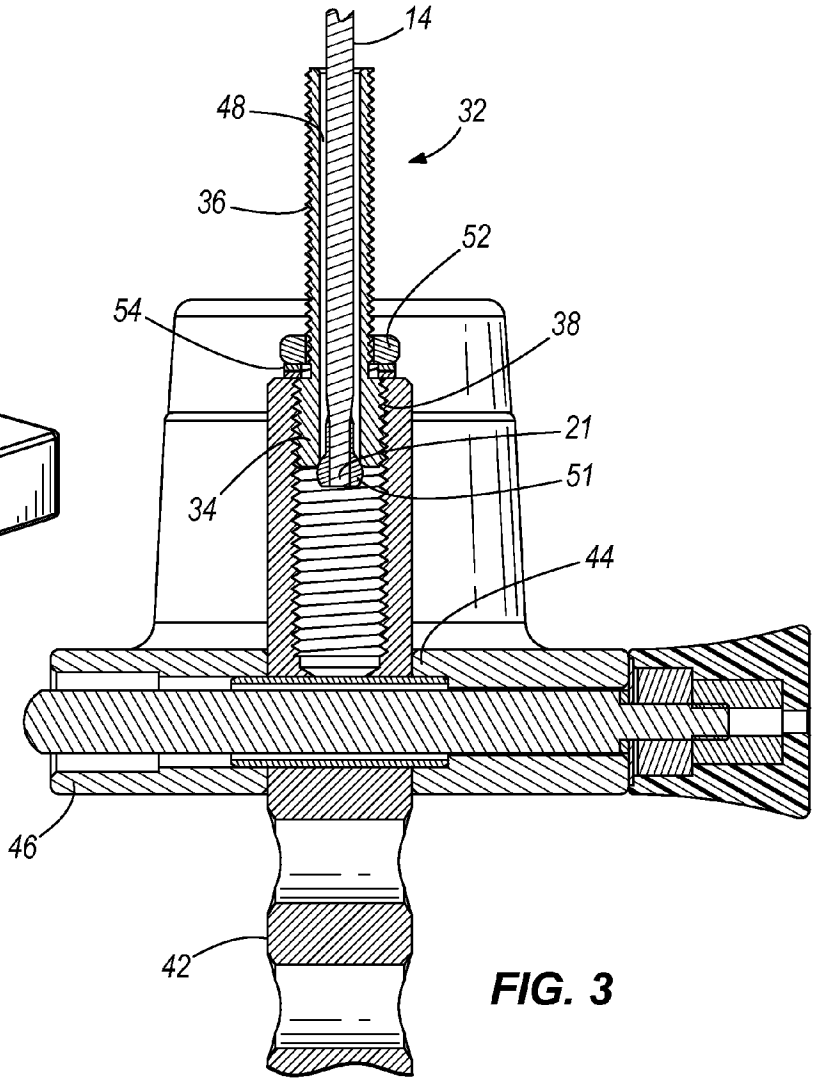
FIG. 3 is a sectional view of section 3-3 taken in FIG. 2.
Figure 6:
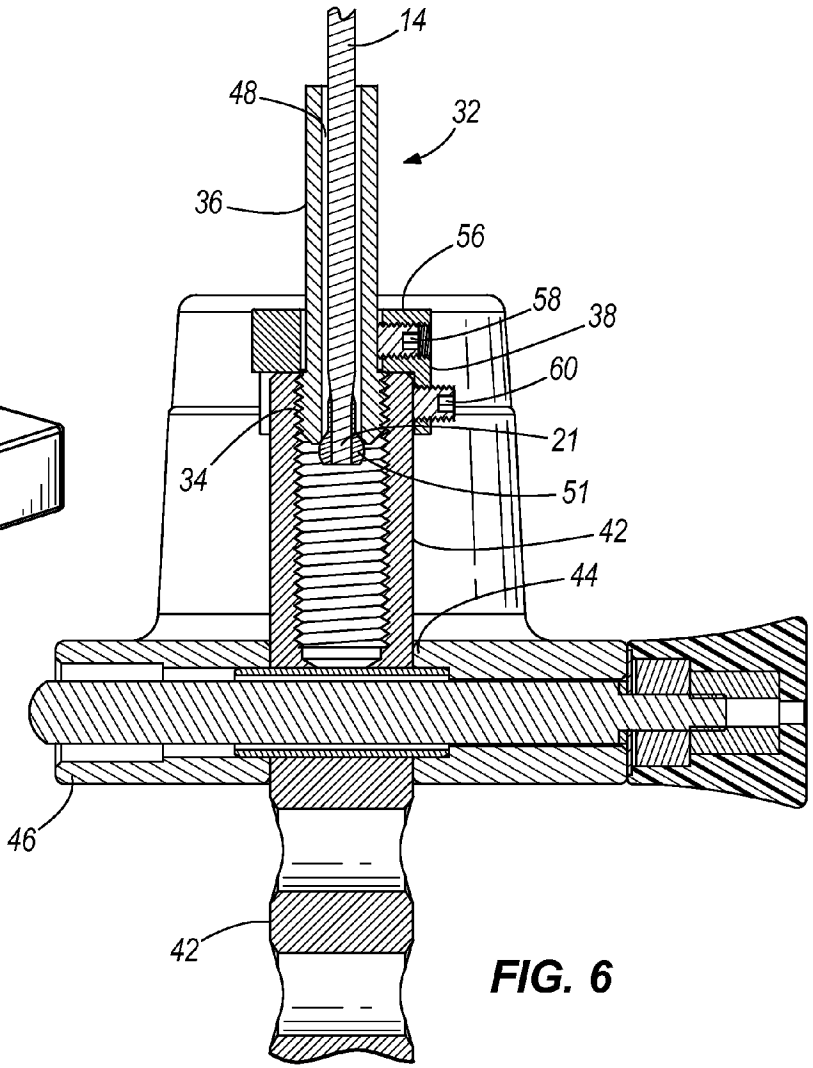
FIG. 6 is a sectional view of section 6-6 taken in FIG. 5.

The connector 32 includes an elongated cylindrical stud having a through-bore 48 that receives the free end 21 of cable 14. As shown in FIGS. 3 and 6, the connector 32 is monolithic, i.e. of a one-piece construction. The cable 14 extends completely through the through-bore 48 from the noted second portion 36 to the first threaded portion 34. The free end 21 of the cable 14 is sized larger than the diameter of the through-bore 48 such that the free end 21 of the cable 14 cannot pass through the through-bore 48. In this example, the free end 21 is fed through the through-bore 48 and a ball 51 is thereafter swaged on the free end 21 to prevent the free end 21 from passing back through the through-bore 48.

As described further herein below, the first threaded portion 34 of the connector 32 has a length L that is equal to a length of threaded engagement between the connector 32 and the weight stack 12 that is recommended and/or necessary to ensure a secure attachment between the cable 14 and weight stack 12 and avoid risk of damage to the weight stack 12 and/or injury to the operator. The connector 32 is thus specially configured so that the operator can visually determine whether the first threaded portion 34 is fully engaged with a threaded receptacle 38 in the weight stack 12. That is, if part of the first threaded portion 34 is not fully disposed in the threaded receptacle 38, the operator will know that the connector 32 is not securely connected to the weight stack 12.

Figure 2:
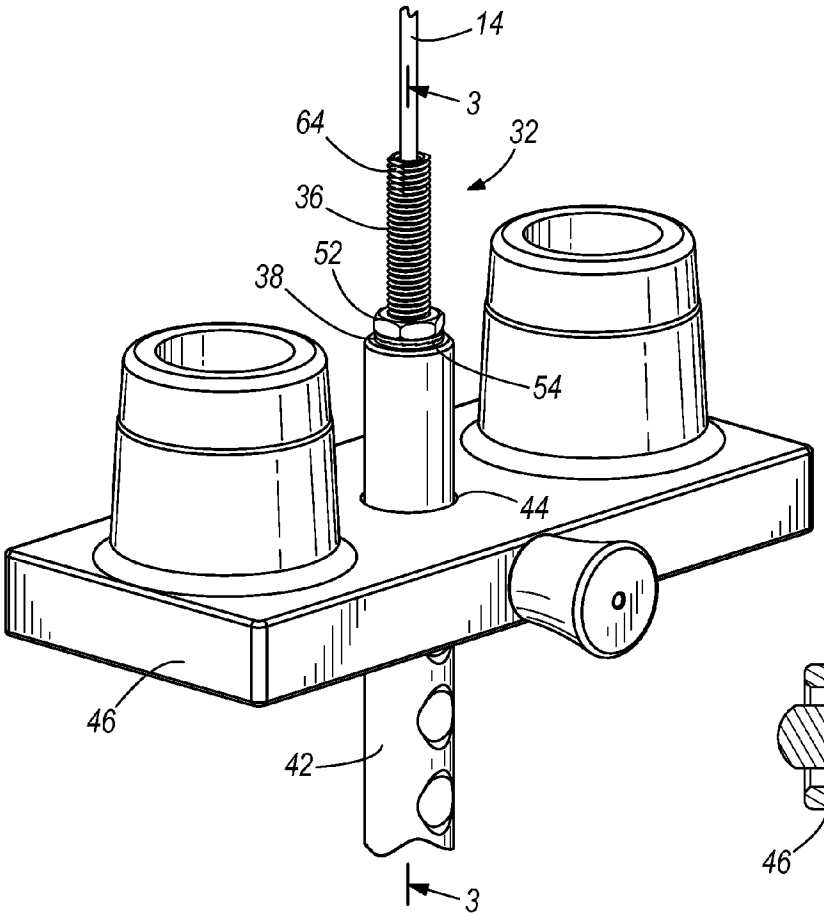
FIG. 2 is a perspective view of an elongated connector for connecting a cable and pulley system to a weight stack.
Figure 4:
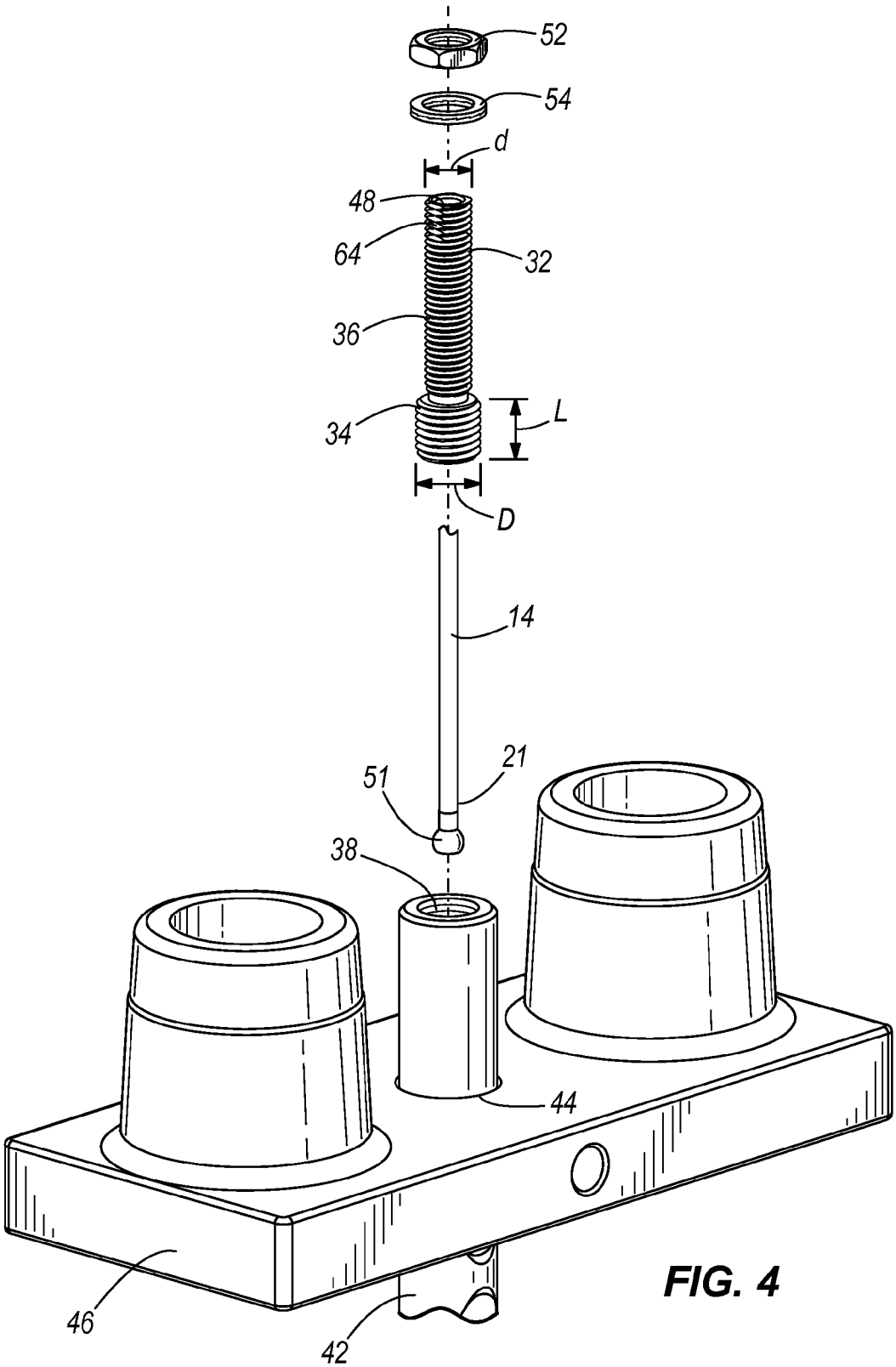
FIG. 4 is an exploded view of the embodiment shown in FIG. 2.

In the embodiment shown in FIGS. 2-4, the second portion 36 of the connector 32 is also threaded. In this example, once the first threaded portion 34 is fully threadingly engaged with the receptacle 38, a jam nut 52 is threaded onto the second portion 36 and threadedly engaged with the second portion 36. The jam nut 52 is sized smaller than the first threaded portion 34 and thus cannot threadedly engage with the first threaded portion 34. Optionally, a plurality of locking washers 54 are sandwiched between the jam nut 52 and the weight stack 12 (in this example via the bayonet 42). The cable 14 extends through the jam nut 52 and locking washers 54. Together, the jam nut 52 and locking washers 54 further ensure a secure attachment of the connector 32 to the weight stack 12.

Figure 5:
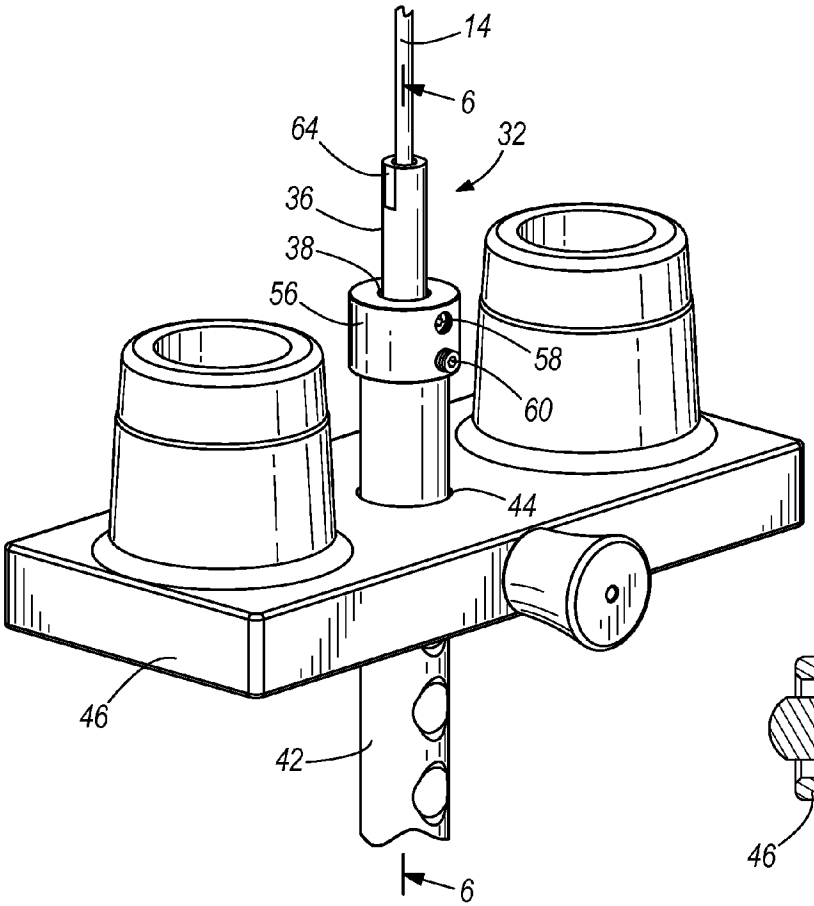
FIG. 5 is a perspective view of another embodiment of an elongated connector for connecting a cable and pulley system to a weight stack.
Figure 7:
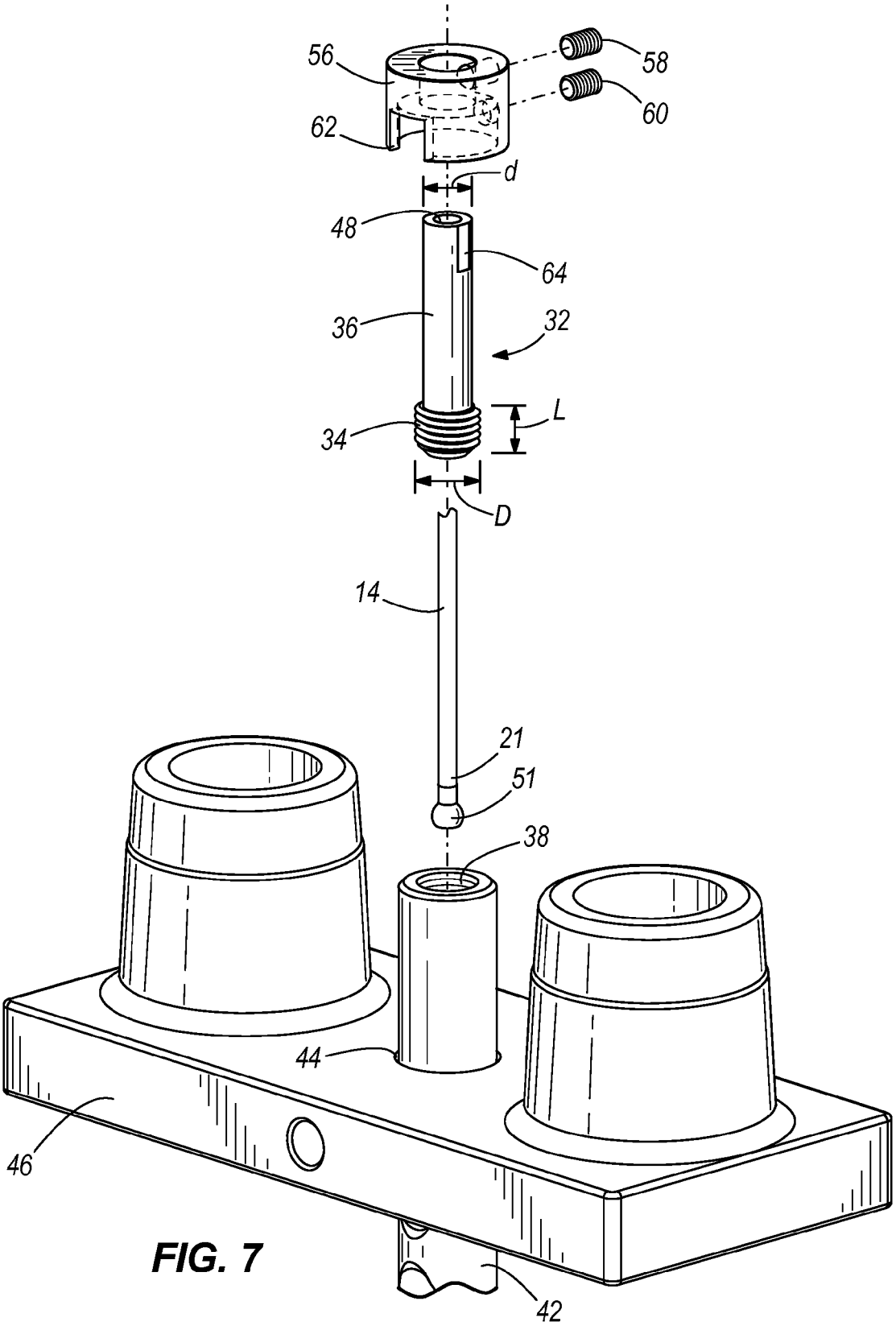
FIG. 7 is an exploded view of the embodiment shown in FIG. 5.

In the alternate embodiment shown in FIGS. 5-7, the second portion 36 is not threaded. A stop collar 56 is disposed on the connector 32. The stop collar 56 has a pair of locking screws 58, 60 configured to engage with the connector 32 and weight stack 12 when the connector 32 is fully engaged with the threaded receptacle 38. More specifically, a first locking screw 58 is configured for engagement with the connector 32 and a second locking screw 60 is configured for engagement with the bayonet 42. A window 62 is provided in the stop collar 56 and is configured to allow the operator to view and identify when the first threaded portion 34 is fully registered or fully seated in the threaded receptacle 38.

Optionally, in any of the disclosed embodiments the second portion 36 of the connector 32 can have opposing flat surfaces 64 on the elongated cylindrical stud that facilitate engagement and manual rotation of the connector 32 by a tool, such as a wrench or an operator's fingers. As mentioned above, the length L of the first threaded portion 34 is configured to equal the acceptable length of threaded engagement between the connector 32 and bayonet 42 that provides secure attachment between the cable 14 and weight stack 12, thus avoiding risk of damage to the weight stack 12 and/or injury to the operator. The flat surfaces 64 enable the operator to more easily turn the connector 32 with respect to the bayonet 42 and thus fully register the first threaded portion 34 into the receptacle 38.

During assembly, the cable 14 can be connected to the weight stack 12 via the elongated connector 32. The unique configuration of the connector 32 allows the operator to confirm that the connector 32 is fully engaged with the weight stack 12 by confirming that the entire length L of the first threaded portion 34 is seated in the threaded receptacle 38. Thereafter, in the embodiment of FIGS. 2-4, the operator can screw the jam nut 52 and locking washer 54 onto the first threaded portion 34 to further secure the attachment. Alternately, in the embodiment of FIGS. 5-7, the operator can secure the stop collar 56 onto the connector 32 to further secure the attachment.

What is claimed is:

1. Exercise equipment comprising:

a weight stack having a plurality of weights that are configured to oppose a given exercise motion through a cable and pulley system;

a head plate that is disposed on the weight stack;

a bayonet that extends from the head plate into the weight stack;

an elongated connector that removably connects the cable and pulley system to the head plate and bayonet;

wherein the elongated connector comprises a monolithic elongated stud having a first threaded cylindrical portion and a second threaded cylindrical portion that axially extends from the first threaded cylindrical portion, wherein the first threaded cylindrical portion has an outer diameter that is greater than an outer diameter of the second threaded cylindrical portion;

wherein the first threaded cylindrical portion is threadingly engaged with a threaded recess on one of the head plate and bayonet and wherein the second threaded cylindrical portion axially extends from the threaded recess, oppositely with respect to the bayonet;

wherein the second threaded cylindrical portion is threadingly engaged with a jam nut;

wherein an operator can visually determine when the elongated connector is not fully engaged with the threaded recess when the first threaded cylindrical portion is not fully disposed in the threaded recess; and wherein an operator can visually determine when the elongated connector is fully engaged with the threaded recess when the first threaded cylindrical portion is fully disposed in the threaded recess.

2. The exercise equipment according to claim 1, wherein the bayonet has a first end that extends into the head plate and a second end that extends into the weight stack and wherein the threaded recess is formed in the first end of the bayonet.

3. The exercise equipment according to claim 1, wherein the monolithic elongated stud has a through-bore that axially extends through the first threaded cylindrical portion and the second threaded cylindrical portion, and wherein the cable extends completely through the through-bore.

4. The exercise equipment according to claim 3, wherein the cable has a free end that is sized larger than a diameter of the through-bore along the first threaded cylindrical portion such that the free end engages with the first threaded cylindrical portion and cannot pass through the through-bore.

5. The exercise equipment according to claim 4, wherein the free end is hall-shaped.

6. The exercise equipment according to claim 1, wherein the jam nut has an inner diameter that is smaller than the outer diameter of the first threaded cylindrical portion such that the jam nut cannot threadingly engage with the first threaded cylindrical portion.

7. The exercise equipment according to claim 6, further comprising a locking washer that is sandwiched between the jam nut and the threaded recess, wherein the cable extends through the locking washer.

8. The exercise equipment according to claim 1, further comprising a stop collar that is disposed on the elongated connector, wherein the stop collar comprises at least one locking screw that is engaged with the elongated connector when the elongated connector is fully engaged with the threaded recess.

9. The exercise equipment according to claim 1, wherein the first threaded cylindrical portion comprises at least one flat surface that is configured for engagement with a tool for manually rotating the elongated connector.

10. A method of assembling exercise equipment, the method comprising:

providing a weight stack having a plurality of weights that are configured to oppose a given exercise motion through a cable and pulley system;

providing a head plate disposed on the weight stack;

providing a bayonet extending from the head plate into the weight stack;

connecting the cable and pulley system to the head plate and bayonet via a removable elongated connector;

wherein the removable elongated connector comprises a monolithic elongated stud having a first threaded cylindrical portion and a second threaded cylindrical portion that axially extends from the first threaded cylindrical portion, wherein the first threaded cylindrical portion has an outer diameter that is greater than an outer diameter of the second threaded cylindrical portion;

threadingly engaging the first threaded cylindrical portion with a threaded recess on one of the head plate and bayonet such that the second threaded cylindrical portion axially extends from the threaded recess, oppositely with respect to the bayonet;

threadingly engaging the second threaded cylindrical portion with a jam nut;

visually determining when the removable elongated connector is not fully engaged with the threaded recess when the first threaded cylindrical portion is not fully disposed in the threaded recess; and visually determining when the removable elongated connector is fully engaged with the threaded recess when the first threaded cylindrical portion is fully disposed in the threaded recess.

11. The method according to claim 10, wherein the jam nut has an inner diameter that is smaller than the outer diameter of the first threaded cylindrical portion such that the jam nut cannot threadingly engage with the first threaded cylindrical portion.

12. The method according to claim 11, further comprising sandwiching a locking washer between the jam nut and the head plate, wherein the cable extends through the locking washer.

13. The method according to claim 10, further comprising disposing a stop collar on the removable elongated connector, wherein the stop collar comprises at least one locking screw that is engaged with the removable elongated connector when the removable elongated connector is fully engaged with the threaded recess.

14. The method according to claim 10, wherein the first threaded cylindrical portion comprises at least one flat surface, and the method further comprising manually engaging the at least one flat surface with a tool and manually rotating the removable elongated connector until the first threaded cylindrical portion is fully disposed in the threaded recess.

15. Exercise equipment comprising:

a weight stack having a plurality of weights that are configured to oppose a given exercise motion through a cable and pulley system;

a head plate that is disposed on the weight stack;

a bayonet that extends from the head plate into the weight stack;

and an elongated connector that removably connects the cable and pulley system to the head plate and bayonet;

wherein the elongated connector comprises a monolithic elongated stud having a first threaded cylindrical portion and a second threaded cylindrical portion that axially extends from the first threaded cylindrical portion, wherein the first threaded cylindrical portion has an outer diameter that is greater than an outer diameter of the second threaded cylindrical portion;

wherein the first threaded cylindrical portion is threadingly engaged with a threaded recess on one of the head plate and bayonet and wherein the second threaded cylindrical portion axially extends from the threaded recess, oppositely with respect to the bayonet;

wherein the second threaded cylindrical portion is threadingly engaged with a jam nut;

wherein an operator can visually determine when the elongated connector is not fully engaged with the threaded recess when the first threaded cylindrical portion is not fully disposed in the threaded recess;

wherein an operator can visually determine when the elongated connector is fully engaged with the threaded recess when the first threaded cylindrical portion is fully disposed in the threaded recess;

wherein the monolithic elongated stud has a through-bore that axially extends through the first threaded cylindrical portion and the second threaded cylindrical portion, and wherein the cable extends completely through the through-bore; and wherein the cable has a free end that is sized larger than a diameter of the through-bore along the first threaded cylindrical portion such that the free end engages with the first threaded cylindrical portion and cannot pass through the through-bore.

* * * * *

UNITED STATES PATENT AND TRADEMARK OFFICE

CERTIFICATE OF CORRECTION

PATENT NO. : 9,192,800 B1
APPLICATION NO. : 13/719007
DATED : November 24, 2015
INVENTOR(S) : Mathew Meyer et al.

It is certified that error appears in the above-identified patent and that said Letters Patent is hereby corrected as shown below:

In The Claims

In claim 5, at column 5, line 52, “hall-shaped” should instead read -- ball-shaped --.

Signed and Sealed this
First Day of March, 2016

Michelle K. Lee

Michelle K. Lee
*Director of the United States Patent and Trademark Office*